US006062430A

United States Patent [19]

Fuchs

[11] Patent Number: 6,062,430

[45] Date of Patent: May 16, 2000

[54] DISPENSING CONTAINER WITH VARIABLE VOLUME COMPENSATION

[75] Inventor: Karl-Heinz Fuchs, Radolfzell, Germany

[73] Assignee: Ing. Erich Pfeiffer GmbH, Germany

[21] Appl. No.: 08/549,745

[22] PCT Filed: Apr. 28, 1994

[86] PCT No.: PCT/EP94/01343

§ 371 Date: Nov. 6, 1995

§ 102(e) Date: Nov. 6, 1995

[87] PCT Pub. No.: WO94/25371

PCT Pub. Date: Nov. 10, 1994

[30] Foreign Application Priority Data

May 5, 1993 [DE] Germany ..... 43 14 762
Feb. 8, 1994 [DE] Germany ..... 44 03 755

[51] Int. Cl.[7] ..... B65D 35/56

[52] U.S. Cl. ..... 222/105; 222/212; 222/386.5

[58] Field of Search ..... 222/105, 135, 222/212, 386.5

[56] References Cited

U.S. PATENT DOCUMENTS

| | | | |
|---|---|---|---|
| 566,282 | 8/1896 | Bailey, Jr. | 222/386.5 |
| 2,728,494 | 12/1955 | Hobson | 222/386.5 |
| 3,319,837 | 5/1967 | Mueller | 222/212 |
| 4,154,366 | 5/1979 | Acres | 222/95 |
| 4,239,132 | 12/1980 | Mueller et al. | 222/212 |
| 4,420,100 | 12/1983 | Mueller | 222/205 |
| 4,978,033 | 12/1990 | Chou | 222/386.5 X |

FOREIGN PATENT DOCUMENTS

| | | | |
|---|---|---|---|
| 011394 | 5/1980 | European Pat. Off. . | |
| 1314002 | 11/1962 | France . | |
| 1530565 | 5/1968 | France . | |
| 6605017 | 4/1970 | Germany . | |
| 3339877 | 5/1984 | Germany | 222/386.5 |
| 8602150 | 1/1986 | Germany . | |
| 8901048 | 1/1989 | Germany . | |
| 9106524 | 5/1991 | Germany . | |
| 9106202 | 10/1991 | Germany . | |
| WO 91/09682 | 7/1991 | WIPO . | |

*Primary Examiner*—Joseph A. Kaufman
*Attorney, Agent, or Firm*—Quarles & Brady

[57] ABSTRACT

A dispensing container, comprising: a vessel body container and at least one reception container, the containers defining a container space sub-divided into substantially separated first and second space sections; the vessel body container defining a first container shape in the vicinity of the first space section, the first space section being adapted for receiving a first volume of a first medium; the second space section being adapted for receiving a second volume of a second medium, said first and second volumes being operationally variable; said second space section including a reception space, and being bounded by a section wall expandable to a full-size shape substantially corresponding to the first container shape, and, a pump for expelling at least one of the media with manually exerted pressure, wherein the section wall, when expanded, includes a region substantially free of tension.

28 Claims, 10 Drawing Sheets

DISPENSING CONTAINER WITH VARIABLE VOLUME COMPENSATION

BACKGROUND OF THE INVENTION

1. Field of the Invention

The invention relates to a discharge device for one or more media, which can be gaseous, liquid, pasty, pulverulent, powder-like, etc. and/or a mixture of such use media to be discharged, as well as to a method for the manufacture and filling of such a device.

2. Description of Related Art

Before or after the first discharge of a use medium from a container space, such as a tank, a pressure or pump space or the like, the space can be temporarily or permanently filled only partly with the use medium, the remaining volumes or volume of the container space being filled with a replacement medium not intended for discharge. This can be a medium which does not react e.g. with the use medium and/or does not physically dissolve in the use medium, so that despite the close juxtaposition the two media are clearly separated from one another, at least in the low-flow, calmed state. However, the replacement medium can contain impurities such as dirt, bacteria, etc., which react with and spoil the use medium for its intended medical, cosmetic or other use. In order to avoid this risk it is possible to add to the use or replacement medium preservatives, stabilizers or similar substances, but these are frequently not desired due to medical side effects, for cost reasons, etc.

SUMMARY OF THE INVENTION

The object of the invention is to provide a discharge device and a method of the indicated type, which avoid the disadvantages of known constructions or of the indicated type and in which in particular undesired contamination of the use medium can be significantly reduced or avoided for as long as the use medium is not discharged, being stored in a manner sealed with respect to the exterior.

For achieving this object at least one compensating and/or reception container receives at least one different replacement medium and the reception space for the replacement medium is substantially closed with respect to one or the particular associated container space at least in one operating state. If the reception container is only partly, or not in contact with the use medium, it can be filled e.g. with a replacement medium free from impurities or can be externally hermetically sealed against the penetration of impurities and, as required, the replacement medium can be delivered to areas of the container space free from the use medium by means of one or more line connections. However, it is particularly appropriate if a reception container is bounded with a container wall or the like directly with respect to the use medium, or the container space areas free from the use medium are partly, largely or virtually completely filled and namely essentially independently thereof, with a variable filling level, or to which percentage the use medium fills the container space. Unlike in the case of a climbing or drag member, etc., no large-surface, tight sliding seats are required, which are difficult if not impossible to seal against the penetration of impurities.

As a result of the inventive construction of the space area taken up in volume-variable manner by the use medium, confinement of the use medium within a volume boundary, referred to herein as bounding, is possible substantially independently of the total volume of the container space approximately to the volume of the filling with the use medium, so that there is always an at least approximate complete filling of said space with only the use medium. In the areas in which the use filling is not adjacent to the container vessel, said use filling is substantially only adjacent to the position-variable container wall of the reception container for the replacement medium, so that as a result of the construction according to the invention, instead of for the said actions said construction may only be suitable for protecting the use filling against shaking movements.

Independently of the described effects and actions, the reception container can also influence the pressure of said use medium filling. The reception container can also influence, by position variation of a container wall or the like in the container space, e.g. for the suction of a vacuum or for the discharge of the use medium for producing an overpressure or in other pressure modifications the damping thereof. In addition, one wall of a reception container can be pretensioned in at least one operating state and/or can engage in raisable manner on the inside of a vessel wall and can therefore elastically support the wall. In addition, a reception container can be solely provided for displacing the stored use medium substantially completely from the container space and/or for acquiring the external shape of a vessel substantially independently of the emptying level, because e.g. the reception container restores the walls of the vessel following their cupping or indentation, for example by means of the medium located between it and the wall.

A reception container for a medium separate from the use medium is suitable for virtually random discharge devices or vessels, e.g, bottles, tubes, pump or cylinder spaces of thrust piston pumps, etc., bag casks, canisters, tanks, etc. If the use medium is highly volatile or easily ignitable, a reception container or replacement medium enables dangerous gaseous mixtures to be expelled substantially completely from the container space.

A reception container for the indicated or other purposes is appropriately not constructed as a bellows, whose wall forms over most areas of its extension prefolded joint zones. Instead the wall can assume random folds diverging therefrom and is advantageously sufficiently flexible that the reception container in the emptied state forms a bending-slack bladder, whose facing wall areas engage on one another with their insides without any particular force expenditure. Thus, in the empty state the reception container can be reduced to a space volume, which is significantly smaller than ½, ¼ or in a range of 1/10 to at least 1/50 of its space volume in the maximum filled operating state.

For filling or emptying a reception container and/or container space, it is possible to provide a valve, which is controlled in flow or pressure-dependent manner by mechanical actuation, particularly in such a way that a flow therethrough can only take place in one direction, whereas in the case of flows in the other direction its passage cross-section is reduced or completely closed. The discharge mechanism provided in the vicinity of an outlet, which can also be formed by a vessel-separate pump unit or a thrust piston pump, a bellows pump, etc. and through which the use medium flows during discharge, can influence or bring about the control of the reception container passage. For example, substantially before, during and/or after the outflow of the use medium, the reception container passage can be closed or opened. In particular, the control is so provided that substantially only due to a vacuum resulting from the discharge of a charge of the use medium in the container space, the replacement medium or the reception container is exposed to an attracting action, which leads to its propagation into those space areas of the container space which have become free due to use medium discharge.

The reception container can be partly or completely inserted in the container space through an opening provided in the vicinity of an emptying opening or formed by the latter, and said opening can optionally also be used as an assembly or fitting opening for the positionally secured anchoring of the reception container within the container space. However, it is appropriate to use for this purpose a remote or separate assembly or fitting opening, which e.g. traverses a wall or bottom wall of the vessel facing the container space discharge zone. An assembly wall, which can be simultaneously also used for the positionally secure anchoring of an associated reception container portion, is appropriately made by profiling or the like, much more dimensionally rigid than the walls connected thereto at right angles. This or another assembly wall can also be reinforced by a type of cross-sectional thickening, e.g. by a separate body, such as a mounting support, flange, closure for the assembly opening, valve case or the like. Instead of being filled through an opening in the vicinity of the outlet zone, the vessel space can also be filled with the use medium through an assembly opening and only then is the associated reception container inserted and fitted, and the assembly opening closed by it. The reception container, including the closure, can form a preassembled constructional unit, which is appropriately inserted in stop-limited manner in the assembly opening in such a way that its portions optionally located on the outside of the vessel, or the discharge device, are located in a completely countersunk or flush manner in a depression of the outside thereof.

Independently of the described constructions, the compensating container or the like can be made from the same material or a material with the same characteristics as the remaining boundaries of the container space, e.g. so as not to bring the use medium into contact with different materials, or in order to facilitate a pure-type reuse of the container materials without complicated prior sorting. The inside of the outer container can be provided in all areas coming into contact with the medium with a film-thin or similar lining or coating of a corresponding material, which is appropriately constructed in one piece with the volume-variable compensating or filling body. This filling body is advantageously invertable through an opening in one piece therewith and/or bounded from the outer container accompanied by the turning over of the inside so as to form the outside, so that it can be transferred from its outer position into an inner position in the outer container or in the reverse direction. The opening can be narrower or of the same width as the greatest or median width of the particular container, as a function of the flexibility of the walls of the invertable container. The inversion or bringing of the filling body into the outer container can take place mechanically or additionally or exclusively by at least one driving fluid. which brings about a vacuum constricting or sucking in the filling body in the outer container and/or an overpressure conveying the filling body into the outer container.

Advantageously, the lining or the substantially maximum widened filling body engages in full surface manner on the inside of the outer container in a substantially fold-free manner and engages both on the circumference and on the front faces, and optionally in the vicinity of container openings or connecting pieces, so that a complete emptying of the container space without leaving any cavities is possible. This can in particular be achieved if the outer container is constructed as a mold for the lining or the filling body. If the container body or filling body is produced from a e.g. hollow, cup-shaped, sleeve-like or tubular blank, accompanied by a reduction of the wall thickness by stretching, following the production of the outer container the lining or filling body can be brought into its finished shape, while also the outer container undergoes said shaping. For shaping purposes the outer, lining or filling container, optionally under a suitably increased temperature, can be exposed to a fluid pressure in the interior and/or on the outer circumference exposed to a vacuum, and can thereby be shaped against a mold, which only forms a negative shape of the outer shape or mold. This makes it possible to carry out production by an extrusion or blowing process.

Independently of the described constructions it is also possible to produce two mutually closing and optionally separate space-bounding containers in one operation together and/or partially to substantially, or even completely, in one piece form. At least wall parts of the two containers can have widely varying wall thicknesses representing 5, 10 or 15 times and said values can represent minimum or maximum limits. For example, the walls of a container can be intrinsically stiff and those of the other container can have a much lower strength, so that it is bending-slack or foldable in film-like manner. The two containers can be prefabricated in the reciprocal outer layer and then appropriately the less stiff container is at least partly transferred into the stiffer container.

The constructions according to the invention are also suitable for so-called squeeze bottles from which a use medium is discharged in that the squeeze container is manually compressed and consequently the medium located therein is subject to an overpressure or discharge pressure. In these or similar containers, from two containers receiving separate media by applying the same manual discharge/actuating pressure simultaneously, successively or in time-overlapping manner, a medium can be discharged from both containers and separate outlet openings. A common outlet opening and/or with a position-constant orientation of the discharge device outside the particular discharge opening can be supplied to an application point. For example, the inner container can be exposed by a pressure rise in the outer container by means of the fluid contained therein to the action of an overpressure through which the medium contained therein is discharged. In the case of a pressure relief, the compensating space of the inner container can then be refilled by a volume corresponding to the volume discharged therefrom, plus the volume discharged from the outer or medium container. If, as is conceivable, in the compensating container no medium is sucked from the outside-adjacent outlet opening of the discharge device or medium container, a separate suction opening from the compensating container outlet opening can be provided and is e.g. linked with the atmosphere. For controlling said discharge or refilling of the compensating container, it is possible to provide a corresponding valve control, optionally with alternately or displaced opening and closing valves, which operate in a pressure and/or path-dependent or mechanically controlled manner.

The invention also relates to a method for the manufacture of a discharge device which can be constructed in the described or some other way. According to the invention at least two containers, which have substantially different or approximately identical, but in particular, not inherently rigid wall thicknesses, can be manufactured or molded in reciprocal material connection, after which they are transferred from this position into a different operating or initial operating position. This permits a very simple manufacture, e.g. in one piece, a manufacture in the heat and/or a manufacture in a single working process, provided that the shaping or molding of the two containers is not intended completely or at least partly in time-succeeding manner, so that after the complete shaping or molding of one another the other still has to undergo shaping or molding.

The invention also relates to a method for filling a discharge device of the described or some other type, particularly for filling with one of the said media or fluids. The container space to be filled, prior to filling, is appropriately reduced to a substantially or completely cavity-free volume and is then so filled with the medium that it is only widened to the volume of the particular medium introduced until it has taken up its predetermined filling quantity. This completely prevents the penetration of extraneous medium or air to the filling space and the discharge device in the filled starting state can be filled in bubble-free manner. The use of a volume-variable compensating container enables filling to take place under an overpressure, which works against the internal pressure of the compensating container and leads to its accompanying emptying or reduction and/or the compensating container can by means of evacuation be placed under a vacuum, which leads to a suction of the medium into the container space.

In each case the particular container, e.g. the compensating container, can be so constricted during emptying by a random folding, wrinkling or the like of its walls that facing walls are engaged against one another in substantially gap-free manner by their insides, or the container is substantially to completely cavity-free and only takes up a volume corresponding to one or at the most four to five times the material volume of its walls. In particular if the inner container engages in large to complete-surface manner on the inside of the outer container in the maximum widened state, the inner container has on the outside at least one projection or spaced projections, such as folds, ribs or similar spacers, which instead of or in addition to, can be provided on the inside of the outer container, and through which passage gaps are left open for the medium even if the inner container has engaged on the inside of the outer container. This also prevents the inner container from subdividing the outer container into two tightly mutually separated container spaces. As a result of the wrinkled or disordered folding of the inner container it is also possible to ensure that even on its outside no inclusions or closed chambers form, which on emptying the container space could form by constriction and medium filling so that this also ensures a complete emptying of all the medium stored.

DETAILED DESCRIPTION OF THE PREFERRED EMBODIMENTS

Figure 1:
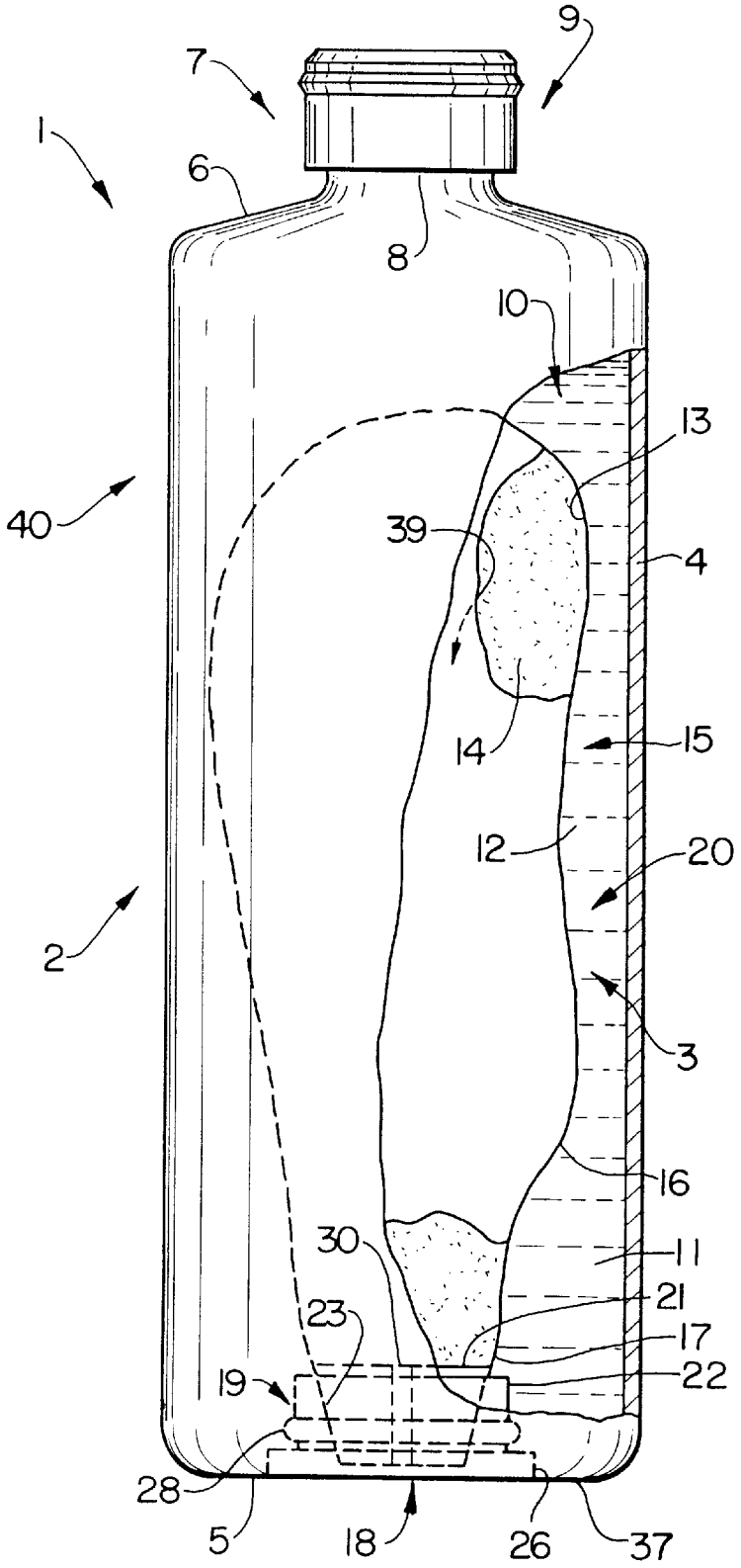
FIG. 1 is a discharge device according to the invention in a part sectional view.

The discharge device 1 has an elongated, bottle-shaped vessel 2 in the form of a thin-walled, hollow vessel body made from soft elastic plastic, which bounds a container space 3 of corresponding shape and which can almost completely be grasped by a hand. The vessel body 2 is substantially formed by continuously approximately constantly thick vessel walls 4, 5 and 6, whose thickness is less than 5 mm, less than 2 mm, and in a presently preferred embodiment, is as small as approximately 1 mm. An approximately cylindrical vessel jacket 4 is connected at one end in one piece to an optionally ring disk-like bottom wall 5 at right angles thereto and at the other end, in the vicinity of a discharge zone 7, to a front wall 6. through which the use medium can be discharged outwards into the open from the vessel 2 by means of a vessel neck 8. The bottom wall 5 and/or the front wall 6, unlike the vessel jacket 4, is substantially dimensionally stable. On or in the dimensionally stable neck 8, projecting outwards in one piece from the front wall 6, is provided a discharge mechanism 9 with a base body inserted in a substantially positionally fixed and centered manner through which the use medium is discharged.

According to the invention for such a discharge device 1, or another, at least one filling compensating means 10 is provided so as to wholly or partly fill the use medium-free space area 13 of the container space 3 in such a way that the area 3 is adjacent in large surface-flush manner directly with the space area 12 taken up by the medium 11. Through flow movements of the medium 11 the two space areas 12, 13 can be shaped in complimentary manner in such a way that e.g. in the case of position changes of the vessel 2, the specifically lighter space area 13 always tends to rise upwards with respect to the space area 12. In the upright position according to FIG. 1, the space area 13 is consequently stretched by buoyancy in the direction of the discharge zone 7, whereas it rises towards the bottom wall 5 in the inverted upside down position.

The space area 13 is substantially completely taken up by a compensating or supplementary medium 14, which with respect to the space area 12, is enclosed in sealed manner in a reception container 15. Reception container 15 is here located in substantially completely encapsulated manner within the container space 3, and like its container wall 16, is substantially freely movable with respect to said space 3 or the space area 12, over most of its extension in the direction of one, two or three space axes. The through, one-piece and approximately constantly thick container wall 16 is substantially bendable and slack, but self-restoring tensile elastic and/or by tensile elongation, permanently deformable without tearing. Without any damage it can be uniformly folded at any random point and therefore the reception container 15 can be so crumpled together that the reception space surrounded by it is reduced towards a zero volume. Through filling with the medium 14, the reception container 15 can be brought to its maximum volume size accompanied by unfolding in continuous manner to all intermediate sizes. In each case longitudinally and/or transversely linking portions of the reception container 15 or the container wall 16 can be deformed or moved substantially independently of one another in said directions and/or at right angles to the surface thereof, and can therefore be adapted to random distributions of the medium 11 in the container space 3 or the space area 12. With a maximum volume size, the reception container 15 can almost completely or at least 80% to 90% fill the container space 3.

At one end the reception container 15, comprising e.g. a seamless bag of a wrinkle film, passes into a container neck 17 or a bag rim, which is constructed in one piece with the remaining container wall 16 and in the tautly widened state can have roughly the same width as the connecting, exposed longitudinal portions of the bag, or can be reduced compared therewith as in the fitted state. In the vicinity of the container neck 17, the reception container 15 is fixed with respect to the container space 3 with a mounting support 18 at a single point 19 located adjacent to the boundary of the space 3, whereas all the remaining areas of the reception container 15 are freely movable in each of the said directions up to a flat-engaging stopping on the vessel walls 4, 5 and 6 with respect to the container space 3.

The reception container 15 forms with the mounting support 18, or one or two mounting support bodies 21, 22, a subassembly 20. Subassembly 20 is preassembled separately from the vessel and in the case of a tightly closed discharge zone 7, can be so installed on the vessel 2 that the bodies 21, 22 are connected in their predetermined functional position with the reception container 15. This subassembly 20, which can optionally be introduced through the neck 8, is then inserted from the outside of an associated vessel wall 5 with most of its extension in the container space 3 and is fixed with respect to the vessel wall 5 by the mounting support 18.

The two approximately coaxial or interengaging mounting support bodies 21, 22 form with approximately complimentary circumferential surfaces a sealing and force fit 23, in whose clamping gap is tautly spread out the container neck 17 and/or fixed in constricted form by a wrinkle fold. A mounting support body 21 is in substantially whole-surface engagement with the inside or inner circumference of the container neck 17 and the other mounting support body 22 engages on the outside or on the outer circumference of approximately the same longitudinal portion of the container neck 17. The clamping faces of the clamping seat 23 are self-locking, acute-angled to conical with approximately the same cone angle and constricted to the outer end of the container neck 17, so that the inner mounting support body 21 formed on the outer circumference of its surface can be inserted from the interior of the reception container 15 into the outer mounting support body 22. The clamping gap of the clamping seat 23 extending up to the outside of the vessel 2 can only be sealed by the container neck 17 located in it and/or consequently both against the use medium 11 and against the compensating medium 14. Between the container neck 17 and the particular clamping or supporting face a direct sealing or adhesive connection is provided, which can be a melt connection, a bonding connection, etc.

Instead of this or in addition thereto, for sealing a supporting gap it is possible to provide a seal 24, e.g. a ring seal. The mounting support body 21 can also be so preassembled with the reception container 15, that the container neck 17 is fixed in its longitudinal direction with respect to said body 21. For this purpose a holding and a clamping member is provided, which clamps the container neck 17 against the outer circumference of the body 21 and/or secures container neck 17 by cross-sectional deformation. The holding member can be formed by the seal 24 and so engages in a circumferential groove in the supporting face of the body 21 with radial pretension that it clamps the container neck 17 in this area in whole-surface manner against the bottom face of the circumferential groove or depression. Following this preassembly, the container neck 17, together with the mounting support body 21 and the holding member 24, can be axially inserted into the mounting support member 22 up to abutment. At the end of the inserting movement, a snap connection locks and its snap member can also be formed by the seal 24. For this purpose the supporting face of the mounting support member 22 can also leave a depression, circumferential groove or similar snap countermember adapted to the snap member 24, which sealingly locks under pretension the seal 24 projecting outwards over the supporting face of the body 21. As the reception container 15 following on to the container neck 17 is highly flexible, its container wall 16 can be applied to its rear end face in the plugging direction for the fitting of the mounting support body 21 and can be pressed into its assembly position via the container wall 16 of the body 21. In this fitting or assembly position, said end face of the mounting support member 21 appropriately projects slightly over the associated end face of the mounting support member 22, the clamping fit 23 extending appropriately approximately up to the latter end face.

The mounting support body 22 which, like the mounting support body 21, is essentially dimensionally stable, forms with its end facing the container space 3 a ring portion 25 projecting freely into the space area 12 and which at the outer end passes in one piece into a ring disk-like support flange 26 projecting over its outer circumference and is closely adapted to an assembly opening 27 traversing the vessel wall 5. This assembly opening 27 is narrower than the inside width or diameter of the container space 3 or the vessel wall 4 following on to the vessel wall 5, so that the container neck 17 and ring portion 25 have a radial spacing with respect to the inside of the vessel wall 4. With a limited axial spacing from the inner, circular, front or support face of the support flange 26, the ring portion 25 carries in a ring groove a circular seal 28 which, like the seal 24, is made from rubber elastic, resilient material and is cross-sectionally elastically deformable by squeezing. By means of said seal 28, the space area 12 is sealed against the outside in the vicinity of the assembly opening 27. The seal 28 and/or another member can also form a snap member of a snap connection 29 with which the mounting support member 22 is secured against the vessel wall 5 in substantially axial clearance-free manner by axial bracing both positively and against rotation in frictionally gripping manner. On inserting the mounting support body 22 preassembled with the seal 28 in the assembly opening 27, the seal 28 is initially automatically radially constricted by sliding along the inner circumference of the opening 27 and then engages over both the inside of the vessel wall 5 and the inner circumference of the assembly opening 27 in such a way that the support face of the support flange 26 engages under the pretension of the seal 28 on the outer face of the vessel wall 5. From the inner front or end face of the mounting support body 21 or 22, the reception container 15 then extends freely into the container space 3.

The reception container 15 can be constructed in completely hermetically sealed manner, optionally as a bladder floating freely in the container space 3, and being fillable e.g. to fill it with a medium, such as a reagent upstream of the closure only openable by destruction and, which adapting to the emptying of the space area 12, undergoes expansion. However, a particularly simple construction is obtained if the reception container 15 or the space area 13 is so refillable corresponding to the reduction in the space area 12, that in said space areas 12, 13, at least in the operative state of the discharge device 1, approximately atmospheric pressure prevails. A compensating passage 30 is provided for this purpose in the subassembly 20 which traverses the mounting support 18 or mounting support body 21 in such a way that it forms a line connection between the interior and exterior of the reception container 15, which in space-saving manner is located at least partly or completely within the container neck 17.

Here the passage 30 forms a connection between the container interior and the outer atmosphere, so that in the reception container 15 or the space area 13, it is possible to suck air from the outside of the container space 3 with a lower flow resistance than it can be ejected again to the outside. These actions could be obtained with a corresponding operation by constructing the passage 30 as a flow restrictor, but a faster response thereof is obtained if a control valve 31, such as a one-way or check valve is provided, which forms a component of the subassembly 20 or the subassembly formed by the reception container 15 and mounting support body 21.

The passage 30 or valve 31 is located roughly in the central axis Of the mounting support 18, which can also be the central axis of the vessel 2, container space 3, vessel walls 4, 5, 6, discharge zone 7, neck 8 and/or discharge mechanism 9, provided that these components are mutually coaxial. A central area of the one-piece mounting support body 1 forms a valve casing 32, in which a circular or disk-shaped valve body 33 is freely movable, without a valve spring, between a closed position and an open position. In the closed position the end face of the valve body 33 engages on a ring disk-like valve seat 34 of the valve case 32. In the open position the valve body 33 engages with the other front face on a valve stop 35, which is formed by a sleeve inserted in a widened bore portion of the valve case 32 and formed by an associated portion of the passage 30. The valve 31 closes for an overpressure and opens for a vacuum in the reception container 15.

The end or insert opening 36 of the through, substantially linear passage outwardly displaced with respect to the valve seat 34 and remote from the interior of the reception container 15, is so countersunk or flush with respect to the outside of the associated vessel wall 5 or support flange 26 surrounding it, that it is unlikely to be closed accidentally even if the outside of the vessel 2 is located on a support face. Radially outside the inlet opening 36 or the support flange 26, the vessel wall 5 forms a circular outside 37 as a stable base for the discharge device 1, and within said outside 37 the vessel wall 5, on the outside forms a depression 38 in which the support flange 26 is located in completely flush manner with respect to the outside 37. As the outer face of the mounting support member 21 is slightly set back compared with that of the mounting support member 22 and in said end face the inlet opening 36 is located, said opening 36 can also be secured against accidental closure by the outer end face of the body 22.

The discharge device 1 is appropriately equipped with a pump 40 with which on the one hand the use medium 11 can be discharged via the discharge zone 7, and on the other hand, the quantity of the specifically heavier compensating medium 14 located in the reception space 39 of the reception container 15 can be modified. For example, during the return of the pump 40 to the starting position following a pump stroke, the reception space can be increased by suction. The pump 40 is here constructed in the manner of a bellows or squeezing pump, namely being operable by the manual constriction of the vessel wall 40 and therefore the outer circumference of the container space 3. The pump 40 is e.g. resiliently self-restoring in that the vessel 2, following compression and release, as a result of its inherent elasticity, returns approximately to its starting shape of the container space 3. On operating the pump 40, a pressure rise is brought about in the pump or container space 3, namely in the space area 12 and space area 13 or in the reception space 39 through which the valve 31 is closed and an outlet valve 44, associated with an outlet duct 43 of the discharge mechanism 9 is opened in pressure-dependent manner. Therefore the use medium 11 passes via an inlet 42 of the outlet duct 43 spaced opposite the vessel wall 6 within the container space into the reception container 15, traverses the valve 44, and passes out of the outlet opening 45 located on the outside of the discharge device 1 or the discharge mechanism 9. The outlet opening 45 can optionally, prior to the initial use, be formed by a completely closed wall, which must be perforated for opening purposes. Operation also leads to a pressure rise of the medium 14 which then, by means of the wall 16, can slowly discharge the medium 11 in the manner of a resilient energy accumulator.

If at the end of this pump stroke the pump 40 is freed from operation, it automatically returns to the starting position, so that a vacuum is formed in the container space 3 or space area 12 or 13, and consequently the valve 31 is opened, so that in the manner of a venting of the container space 3, air is sucked from the outside into the reception container 15 in such a way that the volume of said container 15 is increased by unfolding and/or expansion of its container wall 16 roughly by the volume made free by the preceding discharge of the use medium 11 in the container space 3. At the start of said suction, the valve 44 closes e.g. in pressure-dependent manner and/or before or at the latest on opening the valve 31, so that by means of the outlet 45 no air can be sucked from the outside into the container space 3 or the space area 12. The pump can also be formed by the discharge mechanism 9 and can e.g. be constructed as a bellows and/or piston pump, in which case the vessel wall can also be dimensionally rigid.

With increasing emptying of the space area 12, the reception container 15 is widened, so that the use medium 11 can be redistributed in the vessel space 3 due to the changing gravitational conditions caused by changes to the position of the vessel 2 and correspondingly adapts to the shape of the reception container 15. The container wall 16 can be temporarily flat or slightly adhesively engaged with the inside of the vessel wall 4, 5 and 6 and is then detached again and spaced by the medium 11. Preferably, the use medium 11 is not compressible or less compressible than the compensating medium 14, which with the reception container 15, can form in the container space 3 a displacement or core body scavenged over most of its circumference. The container wall 16 can also engage in the manner of a climbing member in increasing form along the inside with the vessel wall 4 in the direction of the discharge zone 7, so that the space area 12 does not surround the space area 13 in the manner of an envelope, and is instead separated transversely to the central axis from the space area 13 by the interposed front portion of the container wall 16.

The container space 3 with the discharge zone 7 can be filled in the upside down position through the assembly opening 27 with the use medium 11, and only then is the subassembly 20 inserted and the filling opening 27 closed. The substantially empty reception container 15 can initially be applied to or forced into the medium in the container space 3 and then shortly before or during the production of the seal or the snap connection 29, by means of the inlet opening 36 and with a limited overpressure, sufficient compensating medium can be forced into the container 15 that the latter fills all the areas of the container space 3 still free from the use medium 11. Air which was previously present in the areas can escape outwards along the still not snapped in seal 28. The inventive construction is also suitable for such a bubble-free filling of a container space 3 or space area 12. Filling can also take place via the discharge zone 7.

Instead of, or in addition thereto, it is possible to provide an outlet closure 46 which, during said filling or non-use of the discharge device 1, keeps the outlet 45 or outlet duct 43, and/or when providing an outlet valve 44, its valve body 48, closed in pressure-tight manner. A pin 49 or the like removable outwardly in non-destructive manner and then reinsertable prior to the discharge of the use medium 11 can form a closure pin for the outlet opening 45 and/or a positively acting holding down device for the valve body 48. Appropriately, the pin 49 is a component of a snap cover 50 or the like, which can be engaged by means of a snap connection on the outer end of the discharge mechanism 9, the pin 49 projecting from the inside of the cover end wall.

In FIGS. 3 to 12 corresponding parts are given the same reference numerals, but followed by different letters. All the features of claims 1 to 12 can be interchanged or used additively and/or in combination with one another. Thus, several reception containers, mounting supports or filling compensators or discharge devices or mechanisms can be provided for the same container space or separate vessels can be provided, or in a single vessel there can be separate container spaces and/or space areas, so that e.g. separate use media can be discharged as a function of one another or simultaneously and/or independently of one another with the same discharge device. The container space with the inside of its vessel jacket can also form a cylinder path for a pump piston with which, in axially succeeding partial strokes, individual discharge charges can be pressed out, e.g. via a discharge duct traversing the pump piston or plunger.

Figure 3:
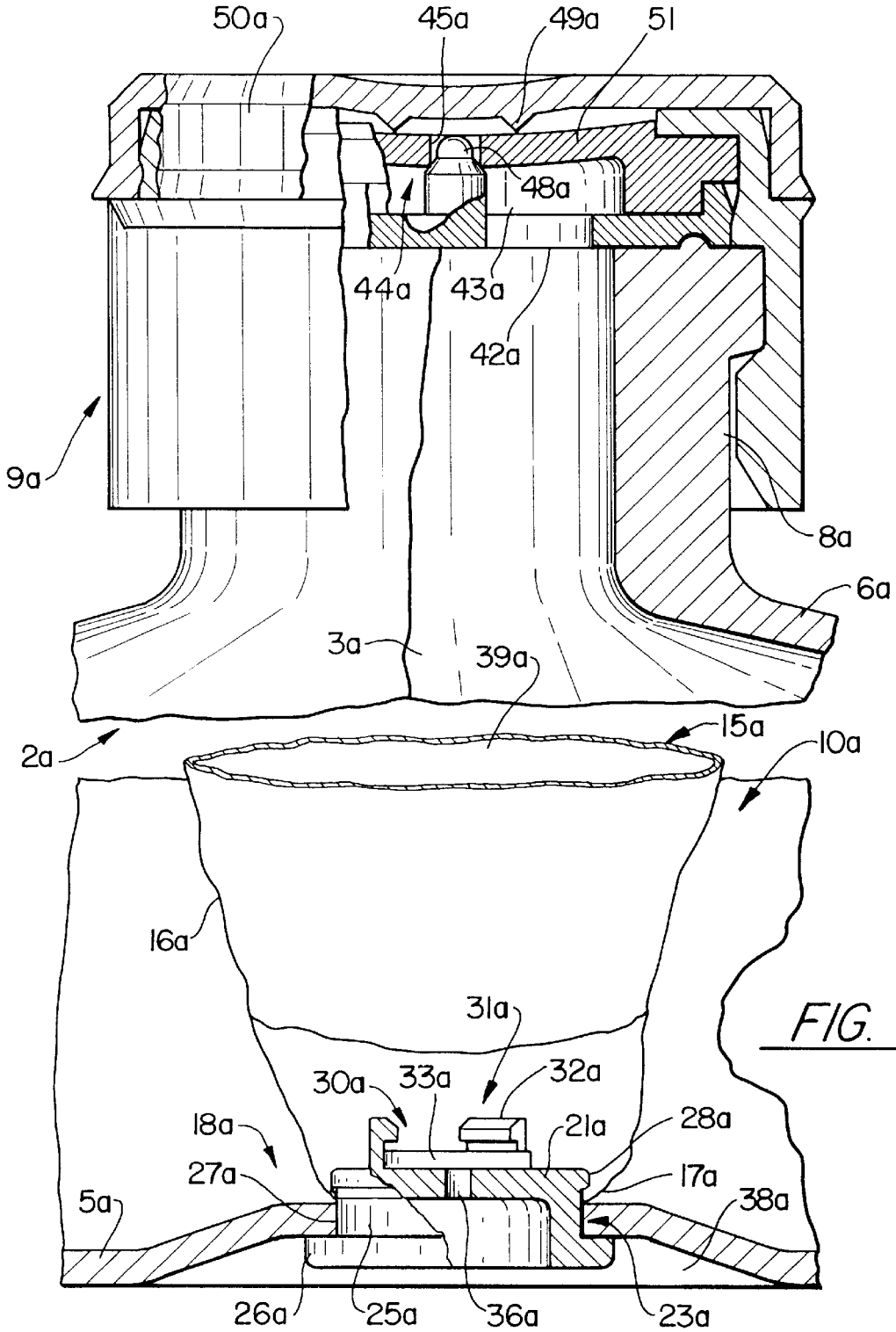
FIGS. 3–4 are further embodiments in representations corresponding to FIG. 2.

In the embodiment according to FIG. 3 the mounting support 18*a* only has one mounting support body 21*a*, the mounting support faces of the force fit 23*a* being formed by the outer circumferential surface of the ring portion 25*a* of the body 29*a* and the inner circumference of the assembly opening 27*a*. The snap member 28*a* is constructed in one piece with the mounting support body 21*a* as a radial collar 28*a* projecting over the ring portion 25*a* connected to the inner end of the body 21*a*. Over said inner end project several circumferentially mutually spaced snap cams 32*a*, which form a valve cage for receiving the valve body 33*a*, so that this small number of only two components is all that is needed for the mounting and the valve. Valve 31*a*, like the valve body 33*a*, is positioned substantially freely within the reception space 39*a*. The outer end of the container neck 17*a* can be located between the support face of the support flange 26*a* constructed in one piece with the mounting support body 21*a* and the outside of the vessel wall 5*a* and also has a pressuretight securing manner in the way described.

Figure 2:
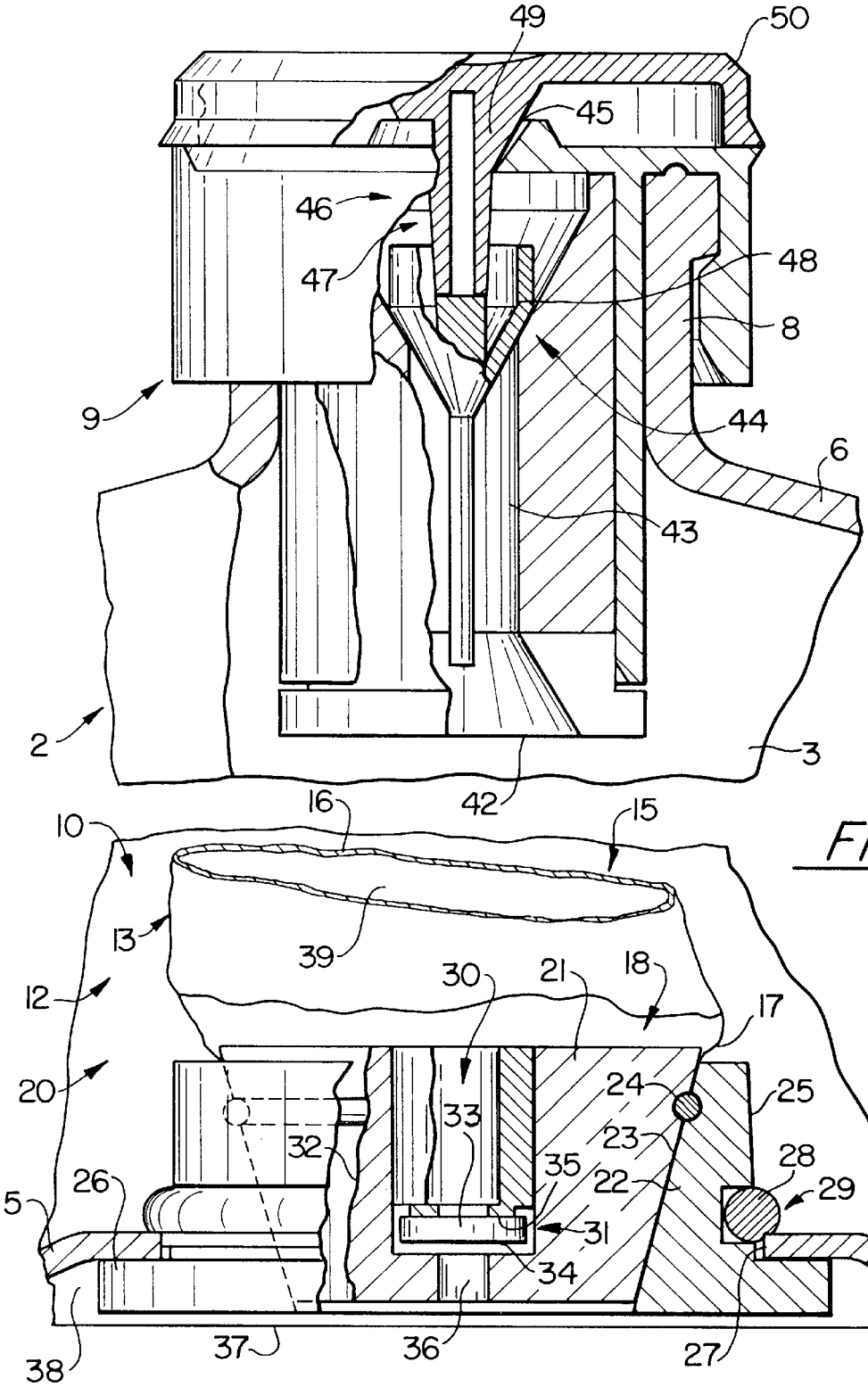
FIG. 2 is the discharge device of FIG. 1 in a larger-scale detail.

Whereas in FIG. 2 the outlet valve 44 is constructed as a one-way or check valve, whose valve body 48 can be moved without the action of a valve spring in pressure-dependent manner only between the closed and open positions, the valve 44*a* according to FIG. 3 has a valve spring 51 constructed in one piece with the valve seat in the manner of a disk valve and which is traversed by an associated portion of the outlet duct 43*a* forming the outlet 45*a* and is formed by the front wall of a ring body fixed to the vessel 2*a*. The valve seat engages on the inside of the valve spring 51 remote from the outlet 45*a*, and whose radially inner area associated with the valve seat is axially movable with respect to its radially outer, axially fixed area. This inner area is maintained in the closed position against the valve body 48*a* by a torus 49*a* of the cover 50*a* surrounding in ring-like radially spaced and approximately tight manner the outlet 45*a*, and which as a pin projects freely from the inside of the valve spring 51 in the direction of the outlet 45*a* and is essentially not located within the neck, but follows on to its outer front face.

Figure 4:
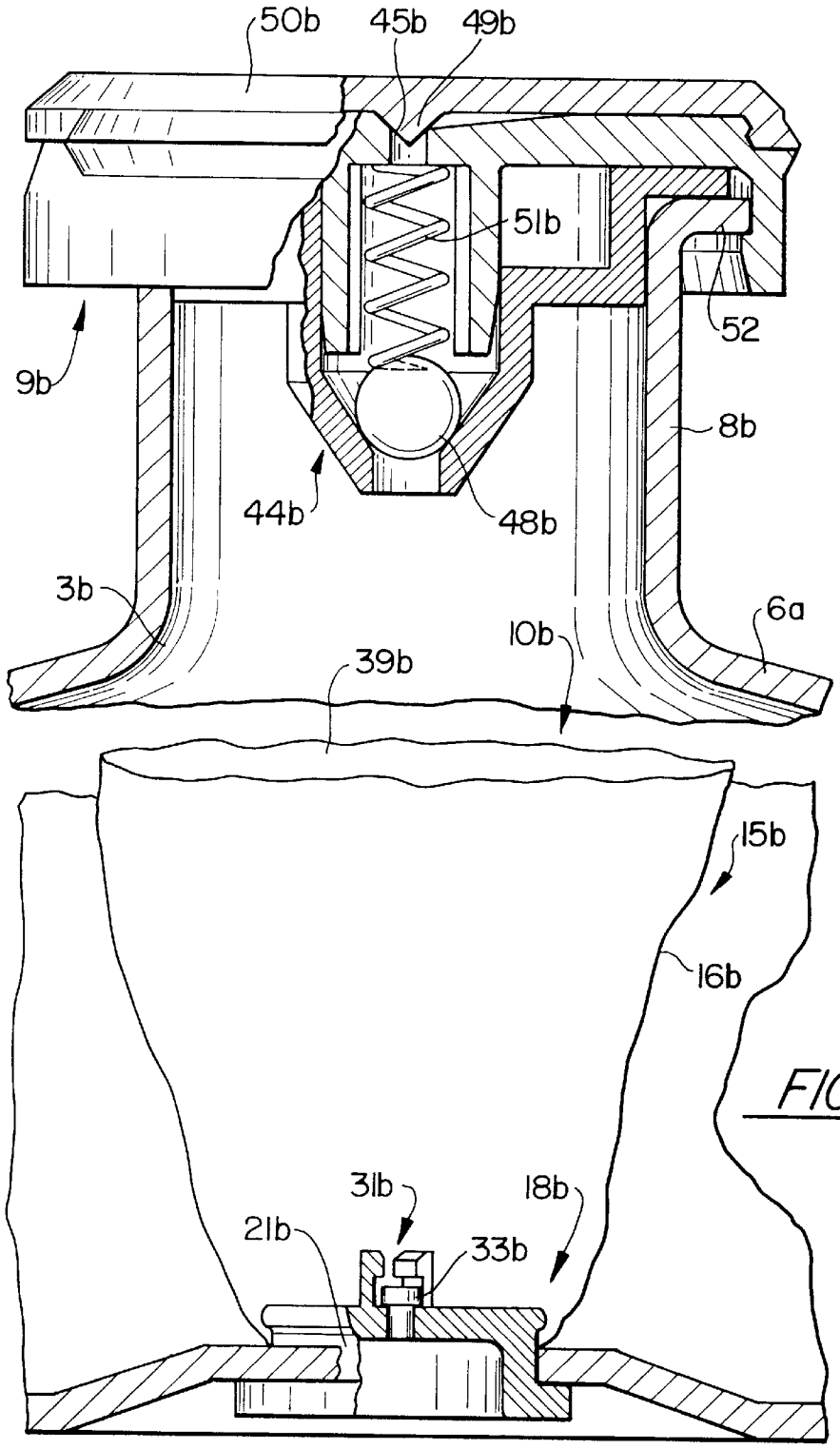

Whereas in the embodiments according to FIGS. 1 to 3 the neck 8, 8*a* with respect to the vessel walls 4, 5 and 6 is dimensionally stable by wall thickening or has a snap collar for fixing the discharge mechanism 9 or 9*a*, the neck 8*b* of FIG. 4 has roughly the same thickness as the vessel walls. The outer end of the neck which is much narrower than the vessel jacket is cross-sectionally angled for forming an approximately planar, ring disk-like neck flange 52 projecting over its outer circumference. The neck flange 52 used for the snap fixing of the discharge mechanism 9*b* also has roughly the same thickness as the vessel walls or the neck jacket connected to the vessel wall 6*a*.

The outlet valve 44 is here constructed as a ball valve with a spherical valve body 48*b* and an acute-angled, conical valve seat. The valve spring 51*b* acts on the valve body 48*b* formed by a separate helical spring or the like inserted in the valve case and/or is inserted between the valve body 48*b* and the outlet 45*b* in a valve case. Thus, the valve 44*b* is closed if a slight overpressure prevails within the container space 3*b*. The body 33*b* of the valve 31*b* is shown here with a much smaller diameter than in FIGS. 2 and 3.

Figure 5:
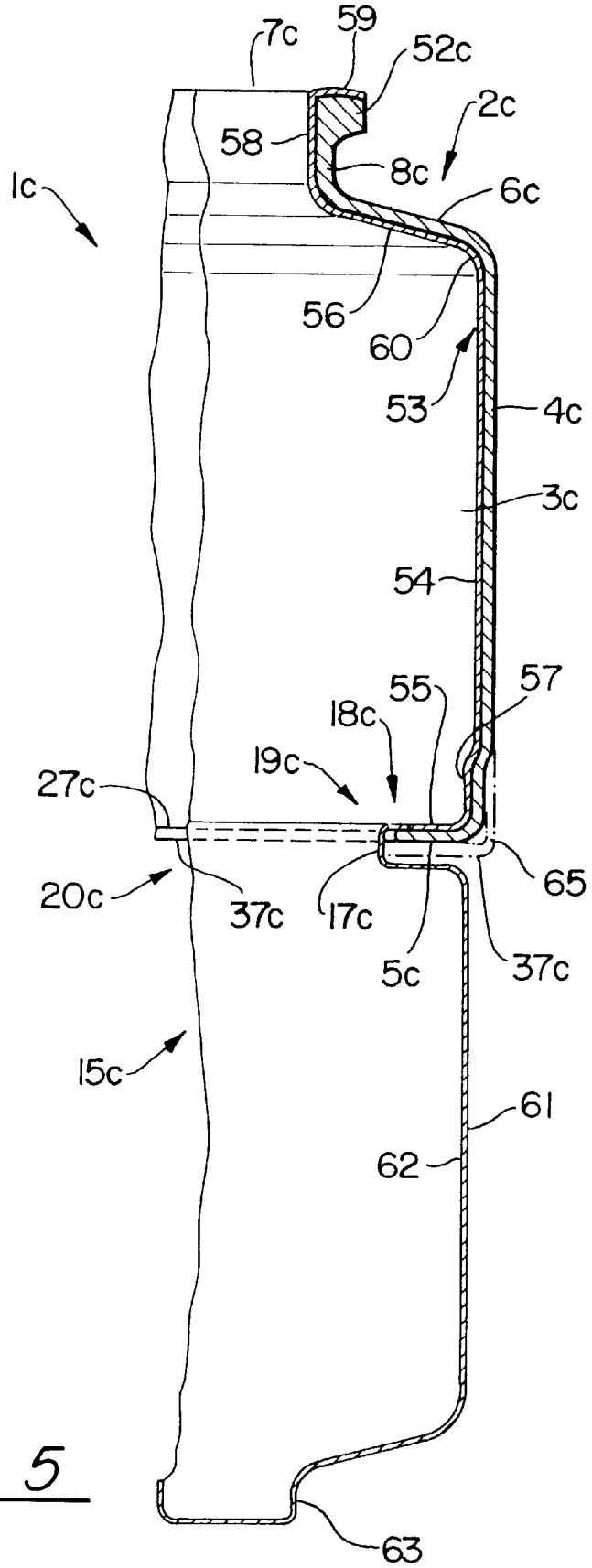
FIGS. 5–6 are embodiments in the finished state.

According to FIG. 5 the insides of one to all the vessel walls 4*c*, 5*c* and 6*c* and the neck 8*c*, and therefore the discharge zone or opening 7*c*, are wholly or partly provided with a thin coating or cover or lining 53, which has an unfixed, or is adhesively fixed, partly or wholly, engagement to the particular inside and forms an inner container 53, as described relative to the compensating container 15. Inner container 53 has a wall made from a thin, bending-slack plastic sheet, which in the substantially fold-free, smoothed position is reinforced by the associated vessel wall, and so at least when the container space 3*c* is filled, is also positionally secured under the fluid pressure.

Jacket wall 54, the ring-disk-like or frustum-shaped bottom and cover walls 55, 56 connected thereto, a portion 57 of the jacket wall 54 directly connected to the wall 55 and narrowed roughly by the thickness of the vessel wall 4*c*, a neck portion emanating from and narrowed with respect to the cover wall 56, and an outer or ring-shaped front portion 59 located outside the container space 3*c*, substantially completely cover the associated vessel wall or the outer front face of the neck 8*c* or the neck flange 52*c*. Adjacent walls pass in one-piece and cross-sectionally over an also substantially full-surface engaging roundness 60 with a constant wall thickness. The radius of curvature of the roundness 60 is larger, e.g. two to five times larger than the thickness of the vessel walls.

The lining 53 can be formed from a film hose blank inserted in the vessel body 2*c* or traversing the same in the opening 7*c*, 27*c* by applying an overpressure in the interior, evacuating the space area between the vessel walls and the lining walls and/or an increased temperature accompanied by permanent wall stretching and widening directly on said insides or the front side of the neck 8*c*, so that the vessel body 2*c* forms the mold and the lining 53 a precise image of the associated faces of the vessel body 2*c* without any gaps. The vessel body 2*c* can be completely shaped or simultaneously shaped in the described manner against a mold determining its external shape, the increased temperature bringing about the necessary adhesion between the walls. However, the lining 53 can also be partly or completely pre-shaped in a separate, multiply reusable mold, cooled or removed and then inserted in the vessel body 2*c* by means of one of the openings 7*c*, 27*c*.

The compensating container 15*c* essentially has the shape and size described relative to the inner container 53, so that in the substantially tension-free, completely widened state can so engage on the outer boundary of the container space 3c formed by the inner container 53 in the way which has been described with respect to the engagement of the inner container 53 on the vessel body 2c. However, during manufacture or assembly the reception container 15c is initially located outside the vessel body 2c, in the axis thereof and as an extension on the bottom wall 5c, the container 15c being connected by means of its jacket neck 17c to the inside of the vessel wall 5c and consequently the mounting support 18c is formed. In this outside position the container 15c, invertable through the interior of the neck 17c, is so turned with respect to its functional position that the function insides 61 of its walls, including the neck 17c are located on its outside and its function outsides 62 on its inside. The walls of the container 15c outside the vessel body 2c are substantially tightly closed, so that its interior only communicates with the container space 3c, and in the case of a sterile or dust-free action on the container space 3c, its side 62 subsequently coming into contact with the medium can be kept clean and sterile.

The arrangement, construction and connection of the walls of the container 15c correspond to what has been described with respect to the walls 54 to 58 of the inner container 53. The constriction 57, not shown, can be provided. The container 15c has at its associated end a hollow projection 63 emanating from its cover wall and which is also constructed in one piece from a film with the remaining walls, and in the extension of the vessel wall 6c, can completely or up to a discharge unit engaging in the neck interior, can fill the interior of the neck 8c, 58. This permits a substantially complete emptying of the medium in the container space 3c by a pressure which conveys the medium upwards.

The container 15c can be produced by the method described relative to the inner container 53 and can therefore be produced in the outside position or together with the inner container 53, the same pressure being built up in both containers 15c, 53, because they surround a common space, which is tightly closed except for the opening 7c used for pressure supply purposes.

It is particularly appropriate if the two containers 15c, 53 are partly or completely produced in one piece or from the same material, which can partly or completely differ from that of the vessel body 2c. The substantially cylindrical jacket neck 17c is connected in one piece, and via ring-like joint zones, directly to the radially inner boundaries of the bottom of the container 15c and the bottom wall 55 of the container 53, the length of the neck 17c being many times, e.g. five to ten times smaller than its width. All the remaining transition roundness between the walls of the container 15c also form circular articulation zones permitting an inversion. The partly or completely shaped container 15c is, after its production, self-inverted from its end remote from the containers 2c, 53 and thereby transferred substantially completely into the container space 3c. However, the container 15c can initially be folded in the outside position to a volume which roughly corresponds to the material volume of its walls or at most two to three times the same, and is only then transferred through the opening 27c on the inside of the vessel wall 55. In both cases the folding or transfer is possible by evacuating the container space 3c or the inner space of the outer container 15c from the opening 7c. If the container 15c is stretched or inverted during the transfer into the container space 3c, through evacuation from the outside of the vessel wall 5c, namely through the turned neck 17c, it can be folded in closely engaging manner onto the bottom 5c, 55.

When the container 15c is entirely located in the container space 3c, the opening 27c can be closed with a cap-like cover 65, whose front wall engages on the outside of the vessel wall 5c and whose jacket wall engages on the outside of the constriction 57 of the vessel wall 4c in such a way that its outer circumference is aligned with that of the vessel wall 4c and passes approximately continuously into it. The cover 65 can carry the control valve for filling the compensating container 15c and forms the base 37c.

In another advantageous procedure the container 15c, inverted or transferred into the container space 3c e.g. by the action of an internal pressure from the neck 17c of the opening 27c, can be so engaged in full-surface manner on the insides of the container space 3c that between it and the insides there are no longer any cavities or air, etc. The use medium can then be filled in bubble-free manner from the opening 7c by a gradient, overpressure and/or underpressure delivery between said walls. The container 15c with the increasing filling volume synchronously gives way or undergoes size reduction by folding. The medium in the compensating container 15c can then escape outwards against an overpressure limiter through the neck 17c, said medium being compressible or gaseous. In the case of a medium or pressure-tight connection of the filling duct to the opening 7c the conveying or delivery of the medium can also take place by suction in the container space 3c, namely e.g. by evacuating the container 15c from the neck 17c. In any case, the container 15c is initially folded with the filling, so that any folding-caused cavities on its outside and completely surrounded by it cannot contain any extraneous medium and instead only the filling medium.

No separate seals are required in the described construction. The sealing of the medium space in the vicinity of the walls 5c, 55 or the opening 27c takes place through the transition in the area 19c or the connection of the neck 17c to the bottom walls 5c, 55. The sealing of a cover or a discharge unit in the vicinity of the opening 7c takes place through the front ring 59, which has corresponding sealing characteristics.

Figure 7:
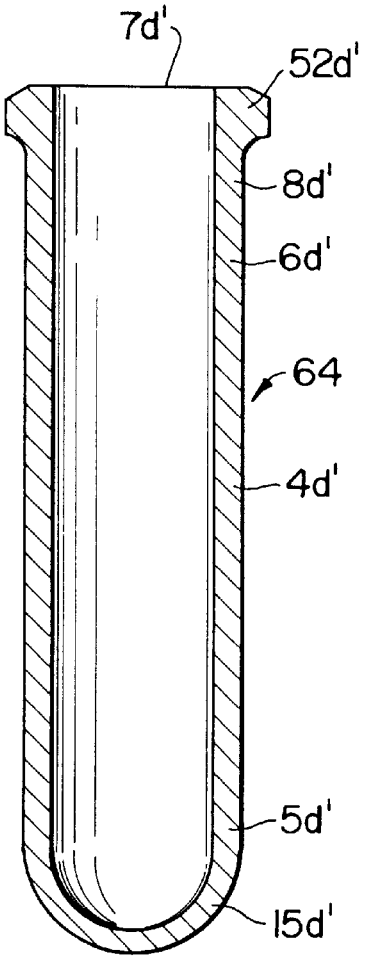
FIG. 7 is a blank for producing the discharge device according to FIG. 6.
Figure 6:
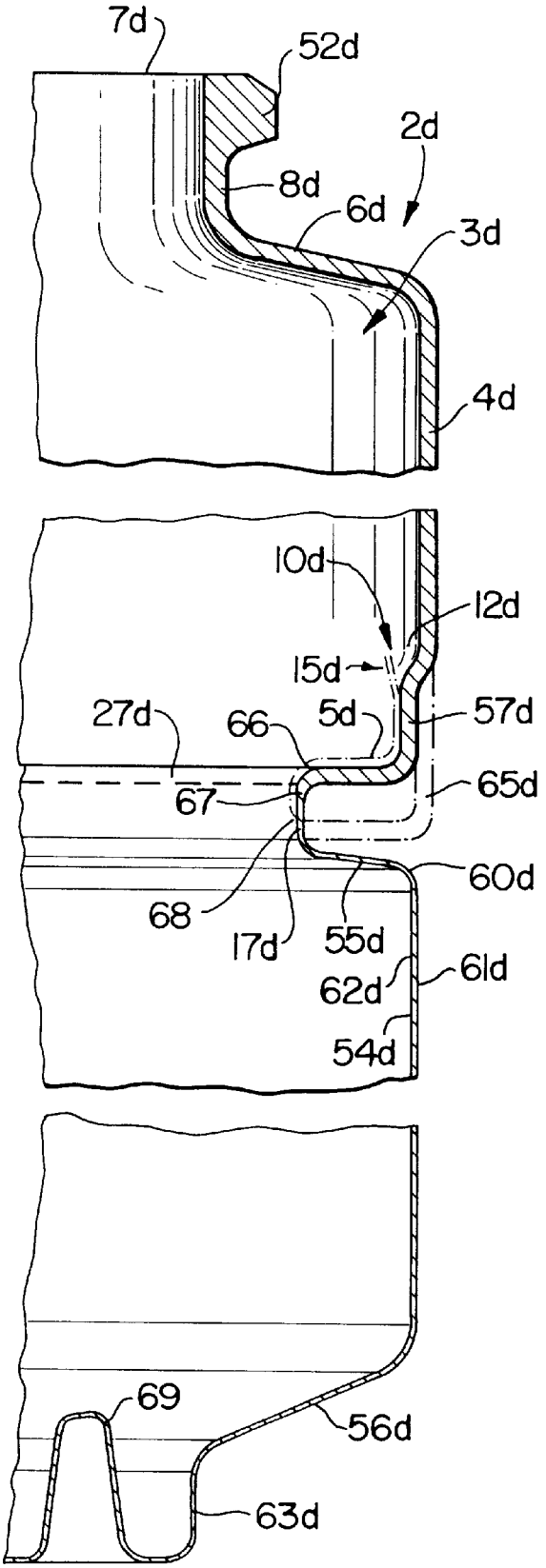
Figure 8:
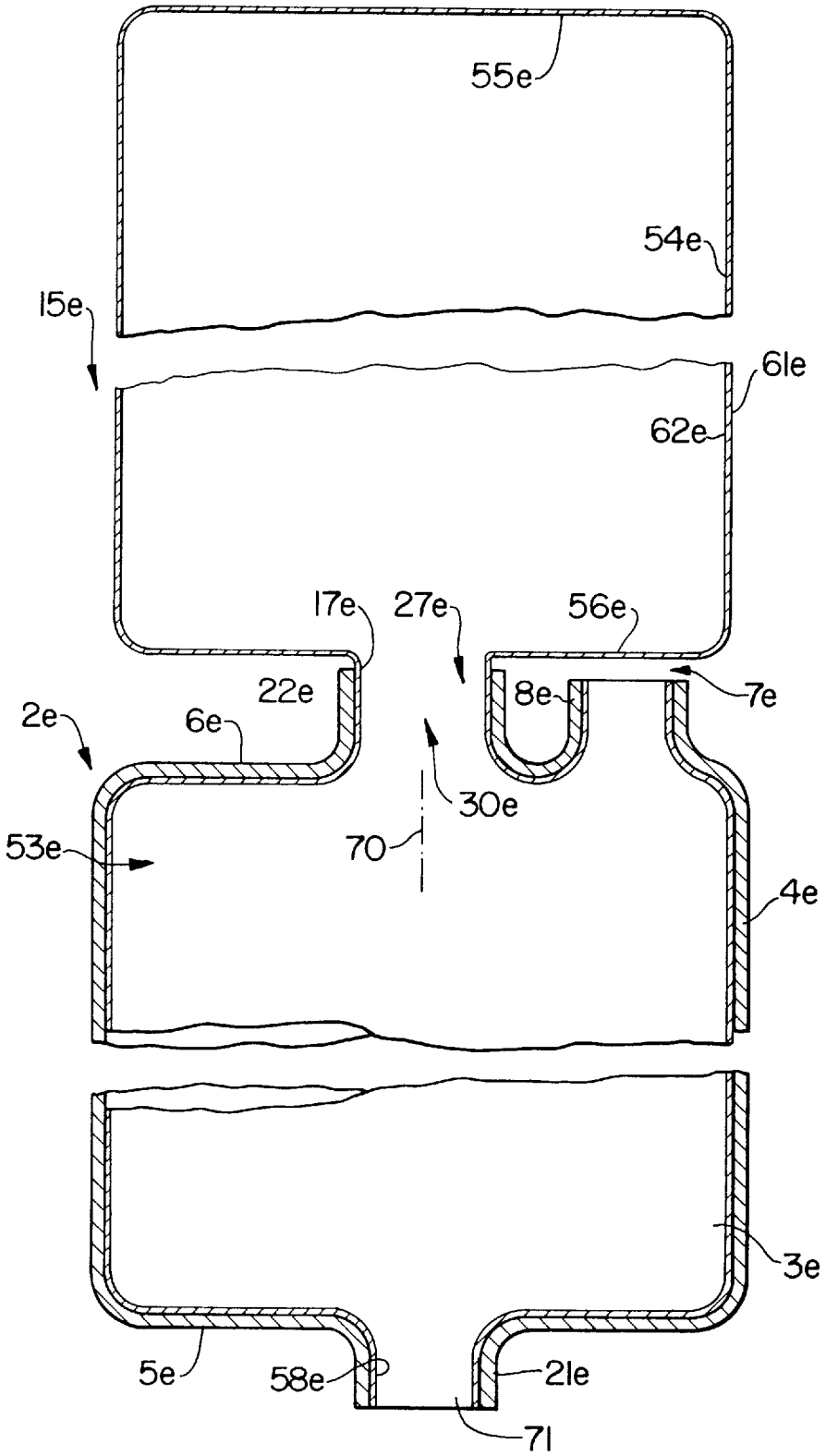
FIG. 8 is another embodiment in a representation corresponding to FIG. 5.

According to FIGS. 6 and 7 the compensating container 15d can also be constructed in one piece with one to all the vessel walls 4d to 6d, 8d, 52d or the areas thereof forming the inside of the container space 3d and/or the outside of the vessel body 2d. The neck 17d here passes in one piece into the vessel wall 5d on its radially inner boundary, which forms a cross-sectionally roughly axially angled and exclusively outwardly projecting, ringlike closed step 66, which can be rounded in approximately pitch circular or quadrantal manner, and in the vicinity of this transition 67, decreases approximately continuously or in step free manner from the wall thickness of the wall 5d to the much smaller wall thickness of the container 15d or the neck 17d. The last mentioned smallest wall thickness can be at a distance from the outside of said wall 5d corresponding to one to three times the thickness of said wall 5d, or can be reached between the planes of the two sides of the wall 5d. Roughly in the center between its ends, the neck 17d forms an inversion articulation zone, about which it can be folded inwards in double layer form, so that its two layers of in part different thickness form at the end of a step 66 a ring fold-like inversion edge or rim 68. The rim 68 and the step 66 are then completely covered to the outside by the cover 65d, which has the insertion opening for filling the compensating container 5d in the jacket and/or in its front wall, which can be spaced from the bottom wall 5d, accompanied by the formation of a circular cavity.

The through, one-piece subassembly according to FIG. 6 can e.g. be produced from a blank 64 or a one-piece preblank according to FIG. 7, which is here elongated, cup-shaped or sleeve-like as an injection plastic molding. The blank 64 has in prefabricated or finished form the neck flange 52*d'* or the neck 8*d'* bounding the opening 7*d'* and the zones 6*d'*, 4*d'*, 5*d'* for the vessel walls 6*d*, 4*d*, 5*d* connected thereto. The wall zones 4*d'* to 6*d'* have approximately the same thickness, a reduced thickness compared with the finished walls 4*d* to 6*d* and/or approximately the same inside or outside width and pass in step-free manner into one another. The bottom 15*d'* of the blank 64 is connected in cross-sectionally continuous manner to the wall zone 5*d'* and is outwardly constructed in dome or hemispherical cup-shaped manner and can have a smaller wall thickness than the zone 5*d'* to 6*d'*, 8*d'* and advantageously passes continuously into the wall thickness of the zone 5*d'*.

Following manufacture, the blank 64 without complete solidification cooling or in the plastically deformable state from manufacture, can be transferred into a blow mold, which has the characteristics described relative to FIG. 5. Optionally accompanied by a further supply of heat and pressure, the zones 4*d'* to 8*d'*, 52*d'*, accompanied by stretching and plastic deformation, are transferred into the final container shape of FIG. 6*d*, said zones being almost exclusively axially stretched; an inner mold not being required. Zone 15*d'* is also located in a cavity of the outer mold corresponding to the inverted shape of the container 15*d*, said zone 15*d'* being so strongly axially and radially plastically stretched by the internal pressure and without an inner mold that the very thin film wall in the container 15*d* is formed and is connected by means of the transition 67 to the vessel body 2*d*. Thus, both containers 2*d*, 15*d* are simultaneously produced in a single operation, after which by means of the duct supplying the pressure medium a return suction flow can be produced, through which the container 15*d* shaped in the outer layer can be sucked through the opening 27*d* into the container space 3*d* accompanied by folding and the formation of the inversion edge 68. This process can also take place in a separate operation or after removing the subassembly from the mold or after cooling or solidification.

As soon as the discharge unit to be inserted in the neck 8*d*, such as a thrust piston pump, has a casing step projecting freely into the container space 3*d*, the container 15*d* can also have a corresponding, pocket-like depressed receptacle 69, which receives said casing step in substantially gap-free manner. The receptacle 69 emanates in one piece from the circular front wall of the projection 63*d* and can either, in accordance with FIG. 6, be invertable for transfer into the function position or instead of this can project outwards in the shaped state into the interior of the container 15*d* located in the outer position or layer, so that no inversion is needed for transfer into the function position.

The container can also be partly or completely produced in an extrusion or blowing process in such a way that as the medium present, or pressure medium, use is made of carbon monoxide or a gas with similar properties. The containers 2*e*, 53*e* are jointly produced from a double-walled, tubular blank and simultaneously the container 15*e* is produced in the outer position or layer. The blank open at both ends and having approximately constant cross-sections over its length can have a width corresponding to the pipe connections 21*e*, 22*e*, which in the finished vessel body 2*e* only project outwards from the remote outsides of the walls 5*e*, 6*e* and are approximately equiaxially positioned in the central axis 70 of the vessel body 2*e*. On the inner circumference of the connection 22*e* is fixed the neck 17*e* of the container 15*e* or the associated blank, while correspondingly on the other connection 21*e* is fixed the other end of the blank or the neck 58*e*. This connection 21*e* can have an opening 71 for the introduction of the shape-giving pressure medium, for filling the container space 3*e* and/or for fixing a discharge mechanism for the medium or a removable closure. For this purpose, it is also possible to have in laterally displaced manner alongside the connection 22*e*, a neck 8*e* projecting outwards over the wall 6*e* and emanating from the latter and which serves to form the opening 7*e*, also being lined by the container 53*e* up to its end.

Following shaping or molding said lining part closes the opening 7*e* with a front wall, but it can easily be opened by cutting, perforating, etc. On the finished vessel body 2*e* the equally wide connections 21*e*, 22*e* are much narrower than the vessel wall 4*e*. If the opening 7*e* is used for medium discharge, the compensating container 15*e* transferred from its outer position into the container space 3*e* is fixed substantially only in the vicinity of the cover wall 6*e*, so that it expands towards the bottom wall 5*e* with increasing emptying of the use medium. The wall of the container 15*e* or 53*e* associated with the bottom wall 5*e* can be welded to the latter or said container can hang freely against the bottom 5*e* not fixed by the cover wall 6*e*. On the outside the wall 5*e* or 6*e* is appropriately covered by a cover of the indicated type and which also covers the associated connecting piece or pieces. The compensating passage 30*e* passing through the neck 17*e* is here on the same side of the container space 3*e* as the opening 7*e* and immediately alongside the same.

Figure 9:
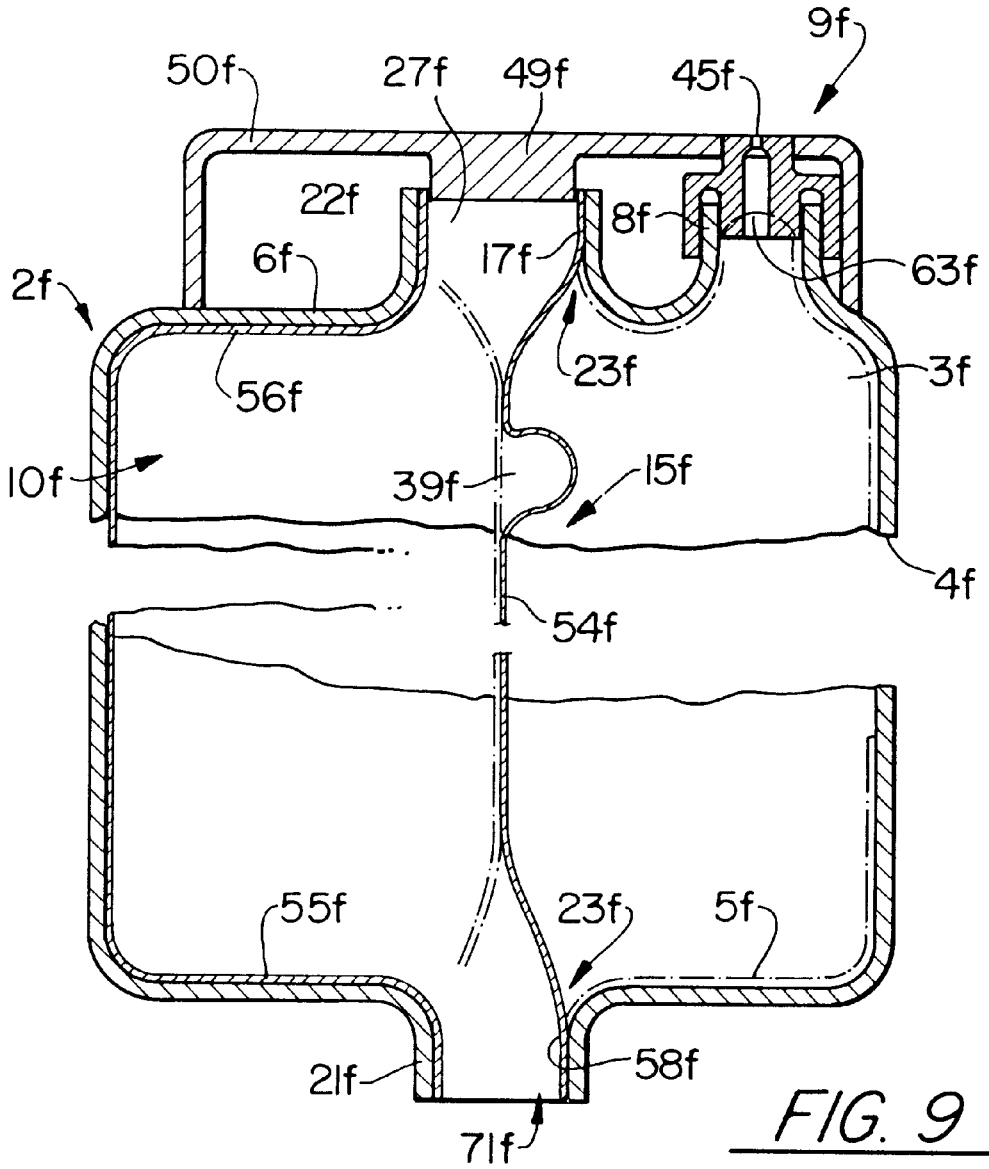
FIG. 9 is another embodiment of a discharge device.
Figure 10:
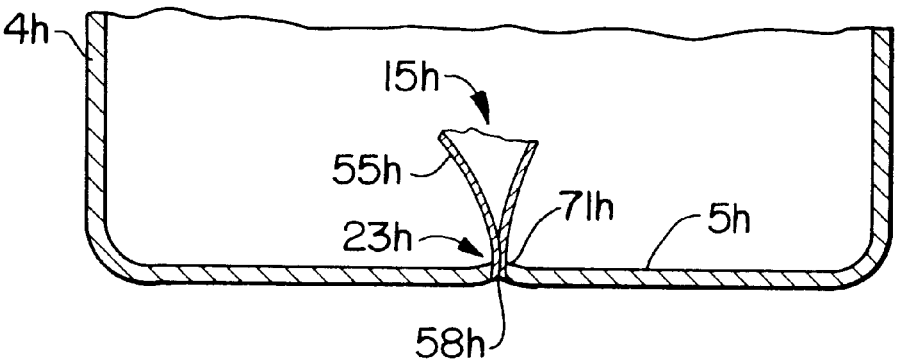
FIG. 10 is a detail of another embodiment.

According to FIG. 9, the necks 17*f*, 58*f* of the substantially tubular compensating container 15*f* are so fixed to the connections 21*f*, 22*f* by fastenings 23*f*, that the main portion of the container 15*f* between them is located in unfixed manner in the container space 3*f*, but is tightly closed to the outside in the vicinity of the connections. The neck 8*f* filling projection 63*f* is indicated in dot-dash line form in its function position and here no separate inner lining has to be provided. By evacuating the reception space 39*f*, the compensating container 15*f* is transferred into its function starting position shown partly in continuous line form and partly in dot-dash line form in FIG. 9, in which the projection 63*f* is also closely folded up. The container 15*f* is then located in the manner of an elongated strand around which the medium completely flows between the walls 5*f*, 6*f* in contact-free manner in the container space 3*f*. From this state the container 15*f* can expand radially and axially in all directions until it engages in gap-free manner on the vessel walls.

The cover 50*f* closes the opening 27*f* with a step 49*f* and is traversed by the outlet opening 45*f* of the discharge mechanism 9*f* inserted in the neck 8*f*, so that it does not have to be removed for discharge purposes. Tie discharge mechanism 9*f* can contain one of the aforementioned outlet valves. The fastening 23*h* on the associated wall can also take place according to FIG. 10 in that the associated end 53*h* of at least one of the inner containers, e.g. the container 15*h* is embedded in the wall 5*h* in such a closely surrounded manner in the folded state that it is connected thereto accompanied by reciprocal welding and closure of the associated opening of the container 15*h*. The wall 5*h* then forms an opening 71*h* substantially completely filled by the embedded portion 58*h* and can partly or completely traverse the wall 5*h*.

Figure 11:
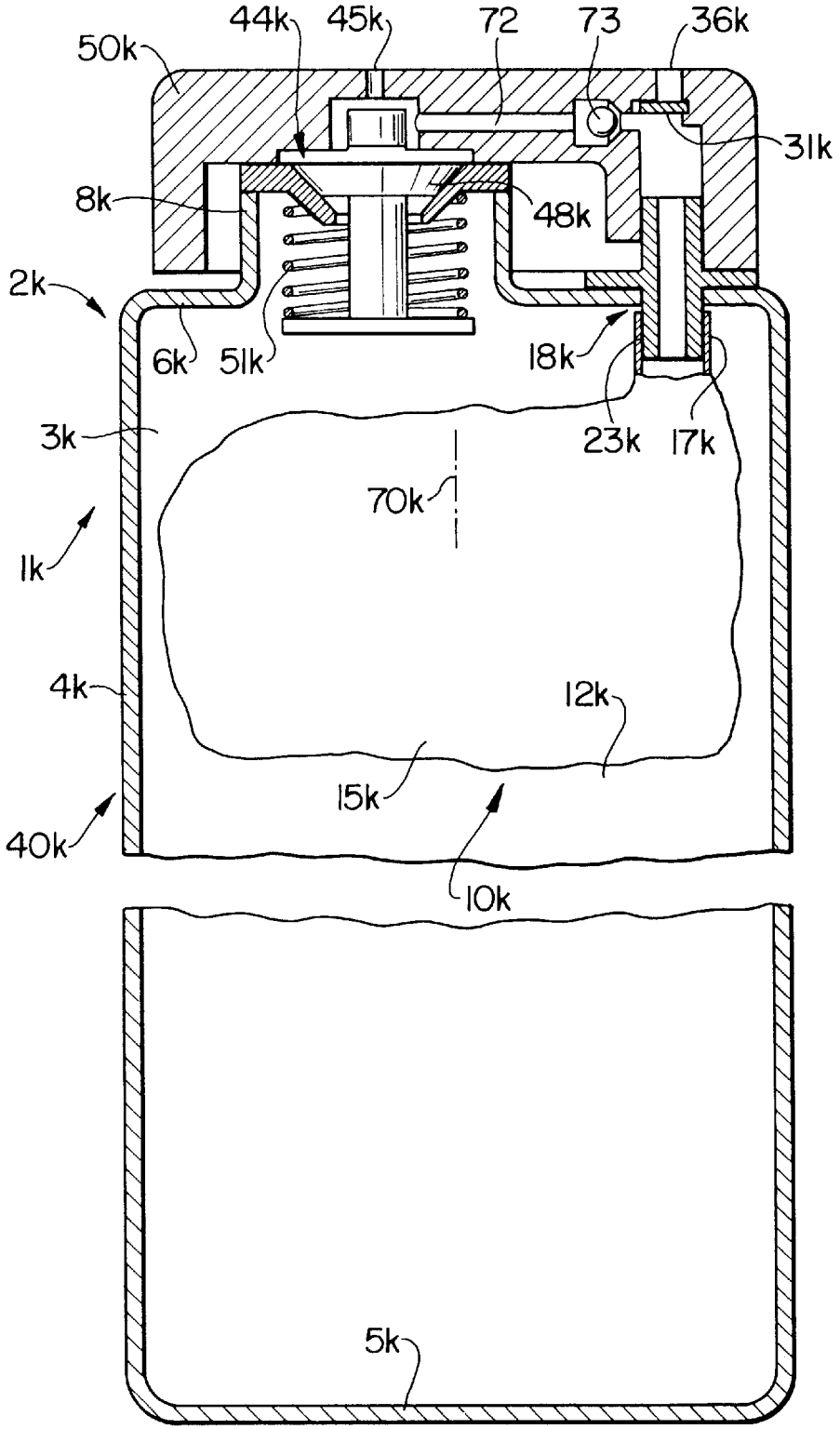
FIGS. 11–12 are two further embodiments in representations corresponding to FIG. 1.

According to FIG. 11 control means are provided in order to e.g. so introduce the medium located in the compensating container 15*k* as a function or action medium that it influences by pressurizing, discharge or the like the discharge behavior or characteristics of the discharge device 1*k*. For example, the air or some other medium in the container 15*k* can be supplied directly upstream and/or downstream of the outlet opening 45*k* to the medium from the space area 12*k* and so finely atomizes the latter outside the device 1*k*, transfers it into a foamed state or in the case of an unatomized, flowing, concentrated beam discharge, can be traversed by the supplied medium. A volume-compensating self-filling suction takes place into the container 15*k* through the inlet 36*k* and via the valve 31*k*. An outlet duct 72, which is separate or branched from the intake duct leads in the cover 50*k* to the discharge nozzle, e.g. into a twisting device between a nozzle cap and a nozzle core inserted therein. In said outlet duct 72 is provided a pressure-dependently operating outlet valve 73, which opens in the case of an overpressure in the container 15*k*, while the valve 31*k* closes. On compressing the vessel wall 4*k* the container 15*k* is pressurizable by means of the incompressible medium in the space area 12*k*, if it is not in direct contact with the vessel walls of the vessel body 2*k*. Thus, the compressible medium in the container 15*k* is pressurized, and simultaneously with the supply of the use medium to the discharge nozzle, is supplied to the latter via the outlet duct 72 and is mixed with the use medium. Following the release of the pump 40*k* the valves 44*k*, 73 close and air is again sucked from the outside into the container 15*k* by means of the valve 31*k*.

The neck 17*k* of the container 15*k* is here mounted on a connecting piece of the mounting support member 21*k* projecting through the vessel wall 6*k* into the container space 3*k*, and which engages with an outwardly projecting end of said connecting piece into the cover 50*k*. The cover 50*k* contains the valves 31*k*, 73, the inlet 36*k* and the outlet duct 72 as well as the discharge nozzle, it then forms a stop for the opened valve body 48*k*. The mounting support 18*k* and the valve 44*k* are both laterally displaced with respect to the axis 70*k*, but the mounting support body 21*k* can also be located in said axis 70*k*, together with the container 15*k* which can be fitted by inversion. Moreover, in the inlet and/or outlet duct of the container 15*k* can be provided at least one screen or filter, e.g. an ultrafine or sterile filter. If at least one or all the valves for the container 15*k* are omitted, said control can also take place by a corresponding reciprocal matching of the inlet and outlet cross-sections. It is also conceivable to suck into the container 15*k* through at least one of optionally several outlet openings 45*k* and clean the same with respect to medium constituents. The wall 5*k* can be completely free from openings and constructed substantially in one piece.

Figure 12:
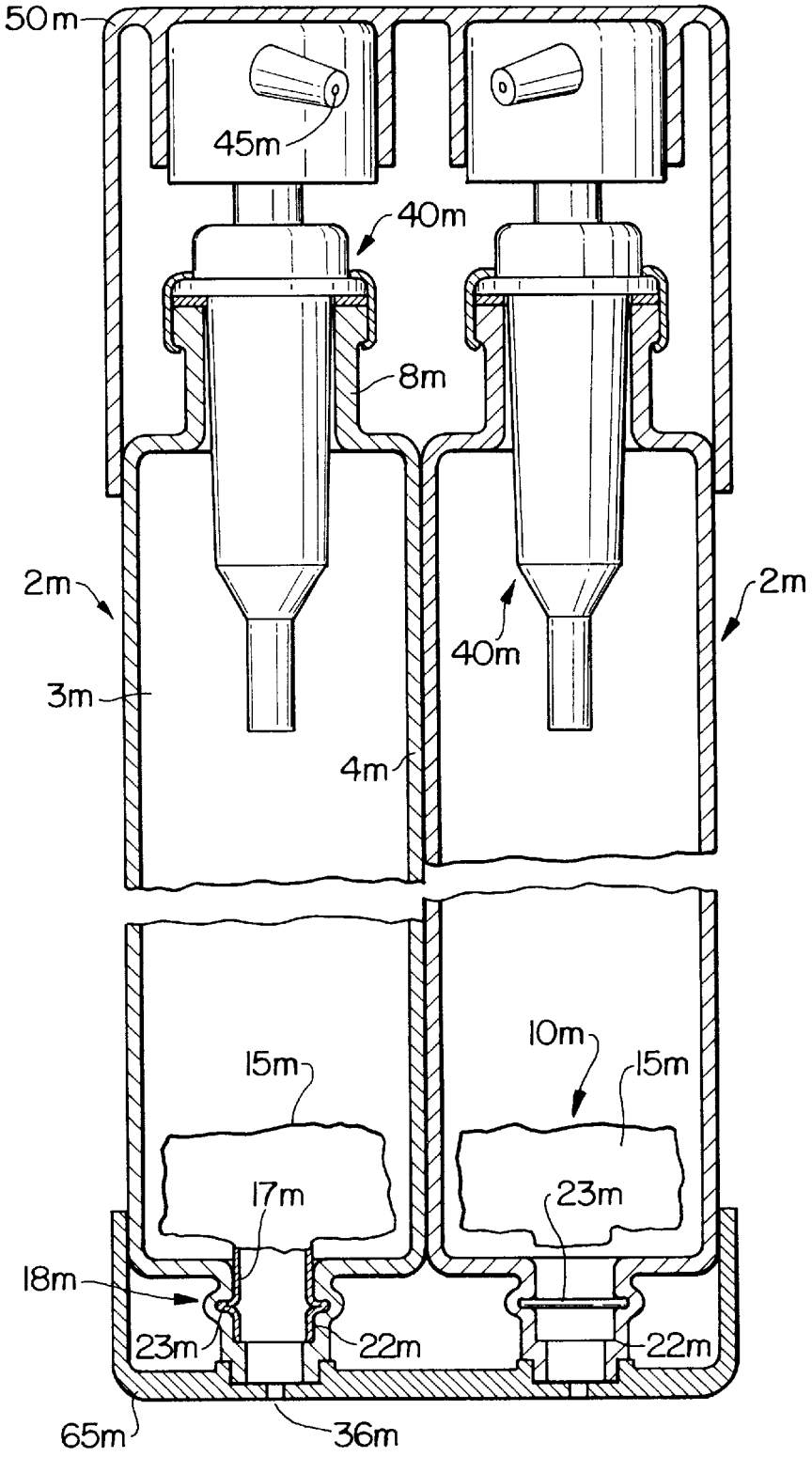

According to FIG. 12 two independently discharge-functional individual discharge units with separate vessel bodies 2*m* and pumps 40*m* are combined into a unit, which can be operated jointly and/or separately, so that two separate media, such as toothpaste, can be simultaneously or successively discharged. The pump 40*m* is inserted in the associated neck 8*m* in approximately completely filling manner and projects into the container space 3*m* in contact-free manner with a casing step, which forms at its free or tubular constricted end the inlet opening for the thrust piston pump 40*m* and can be received in a receptacle corresponding to the receptacle 69 of FIG. 6. Each pump 40*m* has outside the pump casing and the vessel 2*m* on a pump plunger an actuating head with the associated outlet opening 45*m*, both actuating heads being jointly surrounded with the cover 50*m* and operable by means of plug connections, because the latter is axially displaceable with respect to the vessels 2*m* engaging with one another by their walls 4*m*.

The neck 17*m* of the container 15*m* engages under the ring disk-like fold in double layer manner in a ring gap 23*m* on the inner circumference of the connecting piece 22*m*, so that in simple manner the mounting support 18*m* is formed. The ring groove 23*m* can be formed by compression or corresponding double layer folding of the jacket of the connecting piece 22*m* and can be connected in welding-like manner with the radially outwardly projecting ring part of the neck 17*m*. If during the pump stroke small medium quantities pass out of the inlet of the pump 40*m* into the container space 3*m*, the container 15*m* can be constricted by emptying, by means of the valve-free inlet 36*m*. Then, in the case of a self-sucking return stroke of the pump 40*m* and suction of the medium from the container space 3*m*, corresponding to the action of a climbing member, the container 15*m* can follow in widening manner and air can be sucked via the inlet 36*m*.

The discharge device according to the invention operates in any position, e.g. horizontally, upside down or the normal upright position. Advantageously it also allows a preservative-free product storage of the use medium. The outlet valve can also be constructed as a dosing valve, so that e.g. through the valve stroke the discharge medium quantity can be precisely defined for each actuation.

I claim:

1. A dispensing container, comprising:

containers including a vessel body container and at least one reception container, said containers defining a container space sub-divided into substantially separated first and second space sections;

said vessel body container defining a first container shape in the vicinity of said first space section, said first space section being adapted for receiving a first volume of a first medium;

said second space section being adapted for receiving a second volume of a second medium, said first and second volumes being operationally variable;

said second space section including a reception space, and being bounded by a section wall expandable to a full-size shape substantially corresponding to said first container shape, and, at least one pump for expelling at least one of the media with manually exerted pressure, wherein said section wall, when expanded, includes a region substantially free of tension.

2. The dispensing container according to claim 1, wherein said dispensing container defines operating states, and in at least one of said operating states, said reception space is substantially sealingly closed with respect to said first space section, said reception space being connected to at least one compensating passage leading out of said reception space and provided for passing one of the media, said compensating passage being substantially sealingly closeable in at least one of said operating states, said first space section and said reception space being interconnected, but reciprocally flexibly and continuously displaceable in at least one of said operating states, said vessel body container including peripheral vessel walls including a passage wall of substantially constant wall thickness, said compensating passage and said reception container traversing said passage wall, said reception container and said reception space including a narrowed neck section substantially directly connecting to said vessel body container, means being provided for increasing said second volume when said first volume is decreased, when providing said full size shape said section wall being substantially free of foldings.

3. The dispensing container according to claim 1, wherein said reception container is located inside said container space, and bounded by entirely said section wall, an outside of said reception container connecting directly to said first space section, a volume extension of at least one of said reception container and said reception space being variable, and when expanded to said full-size shape, an outside face of said section wall resting directly and fully against an inside face bounding said first space section, said first space section being thereby reduced to substantially nil, and said section wall being free of tensile stresses.

4. The dispensing container according to claim 3, wherein a compensating passage including a passage control connects to said reception space for passage of the second medium, said passage control including passage valves including a one-way valve, said passage valves being controlled as a function of a fluid pressure of an environment, said container space and said reception space.

5. The dispensing container according to claim 3, wherein when assuming said full-size shape, said reception container provides a precise image of said vessel body container and is inherently free of said tensile stresses.

6. The dispensing container according to claim 3, wherein said reception container includes at least one container wall, said at least one container wall being entirely substantially resistance-free, slack, bendable, tension elastic and crease-proof, said at least one container wall providing a bag bladder and being at least partly made from a foil having a thickness extension in a range having an upper limit of 0.2 mm and a lower limit below 0.01 mm, said foil being leak-proof and substantially non-creasing when compressed into a shrunken body with said second volume substantially at zero, said container wall entirely providing said reception container and being weldless.

7. The dispensing container according to claim 6, wherein said section wall substantially entirely bounding said second space section has material characteristics so as to permit compression of said section wall to achieve said shrunken body being substantially cavity-free when said second space section is empty, said shrunken body being inflatable to non-permeably enclose said second space section in operation, said shrunken body providing random folding configurations of said section wall, thereby permitting substantially infinite numbers of said folding configurations.

8. The dispensing container according to claim 1, wherein said reception space is substantially entirely located within said container space, said reception space providing a core having a core outside, most of said core outside being provided for simultaneously contacting the first medium, said reception space defining a reception shape and including said flexible section wall, said reception shape being thereby variable while connecting to the first medium, said vessel body container including a narrowed neck portion, and when free of said tensile stresses, said reception container including a protrusion for entering said neck portion while said reception container is expanded.

9. The dispensing container according to claim 1, wherein said reception container and said reception space are commonly bounded by said section wall, said reception container being fixedly connected to said vessel body container with only a minor part of said container wall, said reception container being fixed at only a single fixing point and projecting from said fixing point as an oblong structure, said container space including an outermost discharge zone for discharging the first medium, said container space including an outermost remote zone substantially opposing said discharge zone, and when substantially entirely expanded, said reception container substantially freely extending from said remote zone spaced from said discharge zone, said reception container thereby including a wall protrusion facing away from said remote zone.

10. The dispensing container according to claim 1, wherein said section wall is included in a one-part component separate from said vessel body container, said one-part component including a lining of said vessel body container, and when expanded to said full-size shape, said section wall and said lining providing a multilayer wall.

11. The dispensing container according to claim 1, further comprising means for invertedly turning said section wall inside out while said section wall simultaneously is fixedly connected to said vessel body container.

12. The dispensing container according to claim 11, wherein said section wall defines a bladder including a bladder belly and a bladder neck, said turning means entirely inverting said bladder belly through said bladder neck while said bladder neck remains fixed to said vessel body container.

13. The dispensing container according to claim 11, wherein said turning means inserts said reception container into said vessel body container from outside said vessel body container.

14. The dispensing container according to claim 1, wherein the second medium comprises a compressible medium for filling said reception container, said compensating passage being connected to an environmental atmosphere, and when fully expanded with the second medium, said reception container defining an inside image of said vessel body container, said inside image including a limited projection and a depression in said limited projection, said region including said projection.

15. The dispensing container according to claim 1, wherein said container space is entirely bounded by space boundaries including end walls, and an intermediate wall connecting to said end walls for varying at least one of said volumes, at least one of said space boundaries being manually positionally variable, at least one of said space boundaries defining a wall plane and being resiliently displaceable transverse to said wall plane, said container space being elastically self-resiliently narrowable, at least one of said end walls being dimensionally inherently stable, said at least one space boundary being separate from said reception container to permit reciprocal motions, one of said end walls including a limited depression and said section wall including a limited protrusion entering said limited depression while said second space section is volumetrically varied.

16. The dispensing container according to claim 1, wherein said at least one pump includes a discharge unit for entirely freeing the first medium from said dispenser, said discharge unit includes an outlet duct for expelling the media and projecting inside said vessel body container, said section wall includes a depression pocket for internally receiving said discharge unit while said section wall is expanded.

17. The dispensing container according to claim 1, wherein said reception container includes a transition section directly fixedly connecting to said vessel body container, said reception container being slackly and thermoplastically shaped directly onto said vessel body without folds, said transition section being made in one part with said section wall.

18. The dispensing container according to claim 1, wherein with said section wall partly expanded said first space section is directly bounded by a mainly concave boundary inside and a mainly convex boundary outside spacedly opposing said concave boundary inside and made in one part with said concave boundary inside, said section wall providing said convex boundary outside, and said concave boundary inside and said convex boundary outside being made from identical materials.

19. The dispensing container according to claim 1, wherein said vessel body container includes an inversion passage, said reception container being inserted for assembly from outside to inside of said vessel body container by invertingly turning said reception container inside out through said inversion passage, and when inverted inside said vessel body container and when fully expanded, said reception container fully attaching to said vessel body container while simultaneously said reception container is free of tensile stresses and said first space section is substantially nil.

20. The dispensing container according to claim 1, wherein said vessel body container has a fluid connection traversed by the first medium of the first filling when emptying said first space section, said reception container including a protrusion entering said fluid connection while said reception container is expanded.

21. The dispensing container according to claim 1, wherein said first and second space sections are bounded by a first space wall and said section wall opposing said first space wall, said first space wall including a lining layer of said vessel body container and directly sealingly connecting to said section wall while said reception container is collapsed.

22. The dispensing container according to claim 21, wherein said lining layer internally engages said vessel body container, said lining layer providing a full surface protection cover of said vessel body container and substantially entirely directly adhesively connecting to said vessel body container to provide a multi-layer wall, said lining layer being made in one part with said reception container.

23. The dispensing container according to claim 1, wherein when deflated, said reception container is fixedly connected to said vessel body container at two separate mutually spaced and opposing fixing locations, and between said fixing locations, said second container being freely expandable.

24. The dispensing container according to claim 23, wherein at each of said fixing locations a boundary of a wall opening of said vessel body container fixedly connects to said section wall.

25. The dispensing container according to claim 1, wherein said reception container is located inside said vessel body container providing a squeezing container, both said reception container and said vessel body container connecting to first and second outlet ducts for the first and second media, said outlet ducts issuing into a medium outlet, and means being provided for simultaneously pressurizing and discharging the first and second media through said medium outlet only by squeezing said vessel body container.

26. The dispensing container according to claim 1, wherein said reception container and said section wall include a wall section traversing a vessel wall of said vessel body container, said wall section being opposingly closely and weldingly embedded within said vessel wall at a fixing point, said reception container thereby being rigidly fixed to said vessel body container when said reception container is deflated.

27. A dispensing container, comprising:

a vessel body container and at least one reception container, said containers defining a container space subdivided into substantially separated first and second space sections;

said vessel body container defining a first container shape in the vicinity of said first space section, said first space section being adapted for receiving a first volume of a first medium;

said second space section being adapted for receiving a second volume of a second medium, said first and second volumes being operationally variable;

said second space section including a reception space; said vessel body container and said section wall including first and second container walls of significantly different first and second wall thicknesses but made in one part; and, said vessel body container including said first container wall having an average wall thickness of at least five to ten times an average wall thickness of said reception container including said second container walls.

28. The dispensing container according to claim 27, wherein a hollow transition neck is provided and interconnects said vessel body container with said reception container in one part, a wall thickness of said transition neck substantially continuously increasing from said reception container to said vessel body container.

* * * * *